United States Patent [19]

Fujikura

[11] 4,435,230

[45] Mar. 6, 1984

[54] ALUMINUM ALLOY PRINTING PLATE AND METHOD FOR MANUFACTURING SAME

[75] Inventor: Chozo Fujikura, Nikko, Japan

[73] Assignee: Furukawa Aluminum Co., Ltd., Tokyo, Japan

[21] Appl. No.: 410,053

[22] Filed: Aug. 20, 1982

[30] Foreign Application Priority Data

Sep. 3, 1981 [JP] Japan ..... 56-139148

[51] Int. Cl.[3] ..... C22C 21/08

[52] U.S. Cl. ..... 148/11.5 A; 420/546; 420/547; 148/440; 101/459; 101/465; 430/278; 430/302; 428/457

[58] Field of Search ..... 420/542, 546, 547, 548, 420/550; 148/11.5 A, 437, 440; 101/459, 465; 430/278, 302; 428/457; 204/129.35, 6

[56] References Cited

U.S. PATENT DOCUMENTS 3,911,819 10/1975 Pryor et al. ..... 101/459
4,272,342 6/1981 Oda et al. ..... 204/129.4

FOREIGN PATENT DOCUMENTS 55-79850 6/1980 Japan ..... 420/546
55-28874 7/1980 Japan .
57-51250 3/1982 Japan ..... 148/11.5 A

OTHER PUBLICATIONS

"Registration Record of Aluminum Association Alloy Designations and Chemical Composition Limits for Wrought Aluminum Alloys", The Aluminum Association, Inc. Sep. 1, 1976.

"Brush Graining of Aluminum for Lithographic Printing Plates", TAGA Proceedings, May 10, 1977.

*Primary Examiner*—L. Dewayne Rutledge
*Assistant Examiner*—Debbie Yee
*Attorney, Agent, or Firm*—Armstrong, Nikaido, Marmelstein & Kubovcik

[57] ABSTRACT

An aluminum alloy plate for printing is composed of 0.05–0.30% Mg, 0.05–0.30% Si, 0.15–0.30% Fe and the remainder Al and ordinary impurities. This printing plate is manufactured through the steps of subjecting an aluminum alloy ingot of this composition to a thermal soaking treatment; carrying out a hot rolling process; then carrying out a cold rolling process on the hot rolled alloy at least at a reduction of 70%; and carrying out low temperature annealing at a temperature of 150°–250° C. for at least one hour.

3 Claims, No Drawings

ALUMINUM ALLOY PRINTING PLATE AND METHOD FOR MANUFACTURING SAME

BACKGROUND OF THE INVENTION

This invention relates to an aluminum alloy plate for printing which permits obtaining a uniform grained surface through a surface graining process suited for offset printing and excels in fatigue resistance. The invention relates also to a method for the manufacture of this aluminum alloy plate.

Generally, aluminum and aluminum alloys are light in weight, excel in workability, are hydrophilic and easy to give surface treatment. They are widely in use as offset printing plates on account of these merits. The conventional printing plates which have been commercially available include plates of thickness 0.1–0.8 mm and in conformity to JIS 1050 (Al of purity at least 99.5%), JIS 1100 (Al—0.05–0.20% Cu alloy), JIS 3003 (Al—0.05–0.20% Cu—1.0–1.5% Mn alloy), etc. Each of these plates is subjected to a surface graining process either by a mechanical process such as ball graining or brushing or by a chemical process such as chemical etching or electrolytic etching. For improvement in printing resistance, the plate is subjected to an anodic oxidation treatment as necessary. Then, a photosensitive agent is applied to the surface of the plate. After that, a printing plate having a printing image is prepared through a plate making process such as effecting an exposure and development. The printing plate prepared in this manner is attached onto a plate cylinder. Ink is applied to the printing image part in the presence of wetting water and is transferred to a rubber blanket. With the ink transferred to the rubber blanket, printing is carried out on a paper surface. Such being the usage, the aluminum or aluminum alloy printing plate must meet the following requirements:

(1) The printing plate must readily give a uniform grained surface through a surface graining treatment for uniform coating with the photosensitive agent, for increased adhesion and for ease of wetting water control during printing.

(2) The printing plate is to be attached onto a plate cylinder by bending two ends thereof and by inserting the bent ends into grooves provided in the plate cylinder. Following this, ink is applied to the printing plate. Then, the ink is transferred to a rubber blanket by pressing the printing plate against the rubber blanket. Therefore, the bent parts of the printing plate are sustaining a repetitive stress. The printing plate is thus expected to have excellent fatigue resistance for standing this repeated bending.

While the above stated aluminum plate of JIS 1050 is given a uniform grained surface through a surface graining treatment, it is inferior in fatigue resistance. The aluminum alloy plates of JIS 1100 and JIS 3003 have a sufficient degree of fatigue resistance. However, they do not give uniform grained surfaces through the surface graining treatment. More specifically stated, the aluminum alloy plate of JIS 1100 or JIS 3003 produces a fine streaky pattern called streaks in the rolling direction of the plate. Then, the surface graining treatment results in uneven shapes of pits. The uneven pits eventually result in insufficient etching parts. Therefore, the grained surface of the aluminum alloy plate thus obtained is not desirable for use as printing plate.

The present invention is directed to the solution of this problem.

SUMMARY OF THE INVENTION

It is an object of the invention to provide a method for obtaining an aluminum alloy plate for printing which gives a uniform grained surface through a surface graining treatment and excels fatigue resistance.

It is another object of the invention to provide an aluminum alloy plate for printing which is composed of 0.05–0.30% Mg, 0.05–0.30% Si, 0.15–0.30% Fe and the remainder Al and ordinary impurities.

DETAILED DESCRIPTION OF THE INVENTION

In accordance with the method for manufacturing an aluminum alloy plate for printing, an aluminum alloy ingot comprising 0.05–0.30% Mg, 0.05–0.30% Si, 0.15–0.30% Fe and the remainder Al and ordinary impurities is subjected to a thermal soaking treatment. The ingot is then subjected to a hot rolling process; the hot rolled alloy is subjected to a cold rolling process which is carried out to the extent of at least reduction of 70%. After the cold rolling process, the alloy is subjected to a low temperature annealing treatment which is carried out at temperature between 150° and 250° C. for a period of at least one hour.

The above stated composition of the aluminum alloy material of the aluminum alloy plate for printing according to the invention is determined for the following reasons:

The Mg is employed for the purpose of improving the strength and the fatigue resistance of the alloy without affecting the surface graining treatment on the plate. Most of the Mg becomes a solid solution in the Al and serves to increase both the strength and fatigue resistance. However, use of it in quantity not exceeding 0.05% gives little effect. Conversely, use of it in quantity exceeding 0.30% degrades rolling workability and affects the uniformity of the grained surface attainable through the surface graining process. The Si and Fe are respectively added for the purpose of further increasing the fatigue resistance. The Si and Fe jointly form an intermetallic compound. They serve to reduce the size of crystalline particles or grains to homogenize the structure. The intermetallic compound and discrete precipitating Si contribute to the improvement in fatigue resistance. However, use of Si in quantity not exceeding 0.05% and use of Fe in quantity not exceeding 0.15% do not give any salient effect. Meanwhile, use of Si and Fe in quantity respectively exceeding 0.30% impairs the uniformity of the grained surface obtainable through the surface graining process. In addition to that, use of Si in quantity exceeding 0.30% also impairs corrosion resistance.

As for the impurities contained in the aluminum alloy usable in forming the printing aluminum alloy plate according to the invention, impurities that are contained in the crude aluminum generally available in the market are allowable to be contained in the printing plate according to the invention. In the case of Cu, however, an excessive Cu content tends to coarsen the shape of pits during the surface graining process. Besides, in such a case, the corrosion resistance of the printing plate degrades. Therefore, the Cu content is preferably limited to 0.05%. Further, with regard to Ti and B which are generally used in the manufacture of ingots are crystal size reducing agents, the quantity of Ti not exceeding 0.03% and that of B not exceeding 0.01% effectively contribute to the homogenization and grain size reduction of the alloy structure.

In the manufacture of the printing aluminum alloy plate according to the invention, an aluminum alloy ingot of the above stated composition is subjected to a thermal soaking treatment to obtain the solid solutions of the Mg and the impurities within the alloy. Concurrently with that, a portion of the Si and Fe are also changed into solid solutions while the intermetallic compound formed between a part of the Si and Fe and the discrete precipitate of Si are uniformly and finely dispersed within the alloy through the thermal soaking treatment. This treatment is carried out at a temperature between 450° and 600° C. preferably over a period of at least three hours. The alloy thus treated is then subjected to an ordinary hot rolling process. The hot rolled alloy is then subjected to a cold rolling process which is carried out at least to a reduction of 70% to have the intermetallic compound of Si and Fe and the discrete precipitate of Si dispersed for the homogenization of the crystalline structure of the alloy. If the reduction rate is less than 70%, the dispersion of the intermetallic compound and the discrete Si is insufficient for obtaining a homogeneous crystalline structure. Then, it becomes hardly possible to obtain a uniform grained surface through the surface graining process. A rolled plate which is obtained in this manner is subjected to a low temperature annealing treatment which is carried out at a temperature between 150° and 250° C. at least for a period of one hour for imparting to the rolled plate a suitable degree of mechanical properties, i.e. a suitable degree of strength and elongation and for increasing its fatigue resistance. The printing aluminum alloy plate according to the invention is prepared in this manner. If the temperature of the low temperature annealing treatment is lower than 150° C., the suitable degree of mechanical properties are hardly obtainable within the above stated length of annealing time. Even if the suitable degree of mechanical properties is obtainable at such a lower temperature, it would require an uneconomically long period of time for the annealing process. Further, if the low temperature annealing process is carried out at a temperature exceeding 250° C., the mechanical properties become lower. Further, the length of time for the low temperature annealing process is set to be at least one hour, because the suitable degree of mechanical properties are hardly obtainable with the process carried out for a length of time shorter than one hour.

The printing aluminum alloy plate obtained in this manner is subjected to a surface graining treatment to have a uniformly grained surface. The surface quality of the aluminum alloy plate favorably compares with the conventional aluminum plate of JIS 1050 while the fatigue resistance of the former is about twice as high as that of the latter.

This invention will be more clearly understood with reference to the following description of Examples:

EXAMPLE 1

Each of the aluminum alloys of composition shown in Table 1 was melted, cast, and scalped on two sides to obtain an ingot measuring 350 mm in thickness, 1000 mm in width and 2000 mm in length. The ingot was subjected to a thermal soaking treatment which was carried out at 550° C. over a period of 10 hours. The treated ingot was hot rolled down to a plate thickness of 4.5 mm. The hot rolled plate was cold rolled at a reduction of 93.3% to a plate thickness of 0.3 mm. The plate thus obtained was subjected to a low temperature annealing process which was carried out at 200° C. over a period of three hours to obtain a printing aluminum alloy plate. For the sake of comparison, a conventional aluminum plate of JIS 1050 was processed in the same manner to obtain a printing aluminum plate.

Fatigue test by repeated bending to an angle of 30°, tensile test and surface graining treatment were carried out on the printing aluminum alloy plate and the conventional printing aluminum plate which were obtained as described above. The results of these tests and treatment were as shown in Table 1.

Further, in carrying out the 30° repeated bending fatigue test, test pieces each measuring 20 mm in width and 100 mm in length were obtained from the printing aluminum plate and the printing aluminum alloy plate respectively. One end of each of these test pieces was secured to a jig. The other end was bent upward to an angle of 30° and then was brought back to the original position. This was considered one bending time and the number of repeated bending times before the test piece came to break was measured.

The surface graining treatment was carried out in the following manner: Each of the printing plates was first degreased with a commercially available detergent. The degreased plate was then subjected to electrolytic etching in a 2% hydrochloric acid bath. The electrolytic etching process was carried out at a bath temperature of 20° C. for a period of one minute. The uniformity of the etching face of each plate was examined. A plate having a uniform grained surface was indicated by a mark o; a plate having an uneven rough surface by a mark x; and a plate having a surface of intermediate degree of uniformity by mark Δ.

TABLE 1

| Printing plate | No. | Alloy composition (wt %) Mg | Si | Fe | Al | Fatigue strength (cycles) | Tensile strength ($kg/mm^2$) | Yield strength ($kg/mm^2$) | Elongation (%) | Uniformity of grained surface |
|---|---|---|---|---|---|---|---|---|---|---|
| Invented plate | 1 | 0.06 | 0.20 | 0.25 | The rest | $580 \times 10^2$ | 16.3 | 14.7 | 3.8 | o |
| Invented plate | 2 | 0.10 | 0.21 | 0.24 | " | $601 \times 10^2$ | 16.6 | 15.1 | 4.1 | o |
| Invented plate | 3 | 0.15 | 0.20 | 0.23 | " | $612 \times 10^2$ | 17.0 | 15.5 | 4.0 | o |
| Invented plate | 4 | 0.30 | 0.20 | 0.22 | " | $620 \times 10^2$ | 18.0 | 16.4 | 5.0 | o |
| Invented plate | 5 | 0.20 | 0.07 | 0.20 | " | $615 \times 10^2$ | 17.1 | 15.5 | 4.2 | o |
| Invented plate | 6 | 0.20 | 0.28 | 0.20 | " | $617 \times 10^2$ | 17.3 | 15.6 | 4.0 | o |
| Invented plate | 7 | 0.20 | 0.20 | 0.15 | " | $605 \times 10^2$ | 16.9 | 15.5 | 4.3 | o |

TABLE 1-continued

| Printing plate | No. | Alloy composition (wt %) Mg | Si | Fe | Al | Fatigue strength (cycles) | Tensile strength (kg/mm²) | Yield strength (kg/mm²) | Elongation (%) | Uniformity of grained surface |
|---|---|---|---|---|---|---|---|---|---|---|
| Invented plate | 8 | 0.20 | 0.20 | 0.30 | " | $618 \times 10^2$ | 17.1 | 15.7 | 4.1 | o |
| Comparison plate | 9 | 0.01 | 0.21 | 0.25 | " | $455 \times 10^2$ | 15.5 | 14.0 | 5.0 | o |
| Comparison plate | 10 | 0.40 | 0.20 | 0.20 | " | $680 \times 10^2$ | 18.3 | 17.0 | 3.5 | Δ |
| Comparison plate | 11 | 0.21 | 0.02 | 0.21 | " | $483 \times 10^2$ | 17.0 | 15.6 | 3.4 | o |
| Comparison plate | 12 | 0.20 | 0.45 | 0.23 | " | $605 \times 10^2$ | 17.2 | 15.3 | 4.0 | Δ |
| Comparison plate | 13 | 0.22 | 0.21 | 0.10 | " | $496 \times 10^2$ | 17.0 | 15.5 | 4.3 | o |
| Comparison plate | 14 | 0.18 | 0.23 | 0.50 | " | $608 \times 10^2$ | 16.9 | 15.3 | 3.9 | x |
| Conventional plate | 15 | | JIS 1050 | | | $300 \times 10^2$ | 15.6 | 14.3 | 6.0 | o |

As apparent from Table 1 above, all the printing aluminum alloy plates No. 1 through No. 8 of the present invention show the fatigue resisting strength of more than 60,000 cycles in the 30° repeated bending fatigue test. Compared with the conventional aluminum plate of JIS 1050, they not only excels in fatigue resisting strength but also good in the uniformity of their grained surface.

Whereas, in the case of the comparison printing aluminum alloy plates No. 9 through No. 14 which deviated from the range of composition of the invention are inferior in the fatigue resisting strength or in the uniformity of the grained surface. In other words, the comparison printing plates No. 9, 11 and 13 which had less Mg, Si and Fe contents were inferior in the fatigue resisting strength while they had good uniformity of grained surfaces. The comparison printing plates No. 10, 12, 14 were good in the fatigue resisting strength but were inferior in the uniformity of their grained surfaces.

EXAMPLE 2

Referring to Table 2, each of the alloy ingots of the composition shown in Table 2 was subjected to the thermal soaking treatment and the hot rolling process which were carried out in the same manner as in Example 1. Then, they were subjected to cold rolling process which was carried out at different reduction. After that, they were subjected to low temperature annealing which was carried out at different temperatures to obtain printing aluminum alloy plates. Each of the printing aluminum alloy plates was subjected to the 30° repeated bending fatigue test, the tensile test and the surface graining treatment which were carried out in the same manner as in Example 1.

Table 2 shows the conditions under which these printing aluminum alloy plates were prepared while Table 3 shows the results of the above stated tests.

TABLE 2

| Printing plate | No. | Alloy composition (wt %) Mg | Si | Fe | Al | Cold rolling conditions: Initial thickness (mm) | Finish thickness (mm) | Red'n (%) | Low temperature annealing, temp. (°C.) × time (hr) |
|---|---|---|---|---|---|---|---|---|---|
| Invented plate | 16 | 0.15 | 0.20 | 0.23 | The rest | 4.5–0.3 | | 93 | 220 × 2 |
| Invented plate | 17 | 0.30 | " | 0.22 | " | " | | " | 150 × 3 |
| Invented plate | 18 | 0.20 | 0.27 | 0.20 | " | 4.5–0.2 | | 95 | 250 × 1 |
| Invented plate | 19 | " | 0.20 | 0.30 | " | 4.5–0.8 | | 82 | 150 × 5 |
| Comparison plate | 20 | 0.15 | " | 0.23 | " | 4.5–0.3 | | 93 | 100 × 3 |
| Comparison plate | 21 | " | " | " | " | " | | " | 270 × 3 |
| Comparison plate | 22 | " | " | " | " | " | | " | 200 × 0.5 |
| Comparison plate | 23 | " | " | " | " | 3.0–1.0 | | 67 | 200 × 3 |

TABLE 3

| Printing plate | No. | Fatigue strength (cycles) | Tensile strength (kg/mm²) | Yield strength (kg/mm²) | Elongation (%) | Uniformity of grained surface |
|---|---|---|---|---|---|---|
| Invented plate | 16 | $611 \times 10^2$ | 17.0 | 15.5 | 3.9 | o |
| Invented plate | 17 | $605 \times 10^2$ | 18.0 | 17.0 | 3.0 | o |

TABLE 3-continued

| Printing plate | No. | Fatigue strength (cycles) | Tensile strength ($kg/mm^2$) | Yield strength ($kg/mm^2$) | Elongation (%) | Uniformity of grained surface |
|---|---|---|---|---|---|---|
| Invented plate | 18 | $621 \times 10^2$ | 16.3 | 14.8 | 6.0 | o |
| Invented plate | 19 | $603 \times 10^2$ | 17.5 | 16.1 | 4.1 | o |
| Comparison plate | 20 | $350 \times 10^2$ | 19.0 | 17.8 | 2.5 | o |
| Comparison plate | 21 | $415 \times 10^2$ | 13.1 | 11.5 | 2.0 | o |
| Comparison plate | 22 | $512 \times 10^2$ | 18.8 | 17.6 | 2.6 | o |
| Comparison plate | 23 | $604 \times 10^2$ | 17.0 | 15.6 | 4.2 | Δ |

Tables 2 and 3 clearly indicate that all the invented printing aluminum alloy plates No. 16–19 which were obtained through the cold rolling at the reduction of at least 70% after hot rolling and further through the low temperature annealing treatment carried out at 150°–250° C. in accordance with the invention show suitable mechanical properties including the fatigue resisting strength of at least $600 \times 10^2$ cycles, tensile strength of at least 16.3 $kg/mm^2$, resistance of at least 14.8 $kg/mm^2$ and give a uniform grained surface through a surface graining treatment.

Meanwhile, both the comparison printing plate No. 20 which was obtained with the annealing treatment carried out at a low temperature and another comparison printing plate No. 21 which was obtained with the annealing treatment carried out at a high temperature are inferior in the fatigue strength. The comparison printing plate No. 22 for which the annealing treatment was carried out over a period less than one hour is also inferior in fatigue strength. Further, it is also apparent that the comparison printing plate which was processed through the low temperature annealing treatment carried out within the prescribed range of the invention is inferior in uniformity of the surface grained through the surface graining treatment, though it has a sufficient degree of fatigue strength, if the reduction of the cold rolling process is less than 70%.

EXAMPLE 3

A photosensitive agent was applied to the invented printing aluminum alloy plates No. 3 and 4 and the conventional printing aluminum plate No. 15 respectively shown in Table 1. After that, exposure and development processes were carried out to obtain finished printing plates. Printing operations were carried out by attaching each of the printing plates onto a plate cylinder of a printing machine to test them for the durability of their bent parts (the number of printing operations repeated before the bent parts came to break). The test results were as shown in Table 4 below.

TABLE 4

| Printing plate | No. | Number of sheets printed before the bent parts of printing plate came to break (sheets) |
|---|---|---|
| Invented printing plate | 3 | $142 \times 10^4$ |
| Invented printing plate | 4 | $151 \times 10^4$ (not broken) |
| Conventional printing plate | 15 | $70 \times 10^4$ |

As will be clearly understood from Table 4 above, compared with the conventional printing plate No. 15 according to JIS 1050, the aluminum alloy printing plates No. 3 and 4 prepared in accordance with the present invention have durability for printing more than twice as high as that of the conventional printing plate.

The printing plate according to the invention has a salient advantage for use in offset printing, because it has fatigue resisting strength and durability for printing at least twice as high as those of the conventional aluminum plate of JIS 1050 and yet has the same degree of surface graining property as the latter.

What is claimed is:

1. An aluminum alloy printing plate comprising a printing plate of an aluminum alloy consisting essentially of 0.05–0.30% Mg, 0.05–0.30% Si, 0.15–0.30% Fe and the remainder Al and ordinary impurities said plate having a uniformed grained surface and a photosensitive layer thereon.

2. A method for producing an aluminum alloy printing plate comprising the steps of:

subjecting an aluminum alloy consisting essentially of 0.05–0.30% Mg, 0.05–0.30% Si, 0.15–0.30% Fe and the remainder Al and ordinary impurities to a thermal soaking treatment, hot-rolling the thus-treated alloy, cold-rolling the hot-rolled alloy at a reduction of at least 70%, annealing the cold-rolled alloy at a temperature between 150° to 250° C. over a period of at least one hour, and roughening the surface of the resulting alloy so as to have a uniformly grained surface.

3. A method for producing an aluminum alloy printing plate as set forth in claim 2, wherein after the roughening treatment, the resultant aluminum alloy plate is coated with a photosensitive layer.

* * * * *